US005316265A

United States Patent [19]

Welch et al.

[11] Patent Number: 5,316,265

[45] Date of Patent: May 31, 1994

[54] REMOTE CONTROLLED SCAFFOLD HOIST

[76] Inventors: James L. Welch, 4292 Valley View; Stephen R. Miller, 4320 Valley View, both of Norco, Calif. 91760

[21] Appl. No.: 760,897

[22] Filed: Sep. 17, 1991

[51] Int. Cl.[5] ..... B66C 13/18; B66C 23/02

[52] U.S. Cl. ..... 254/362; 212/160; 212/179; 212/247

[58] Field of Search ..... 254/338, 329, 378, 362; 212/175, 179, 160, 247

[56] References Cited

U.S. PATENT DOCUMENTS

| | | | |
|---|---|---|---|
| 2,203,113 | 6/1940 | Uecker et al. | 254/338 X |
| 2,557,852 | 6/1951 | Winkel | 212/295 |
| 2,786,583 | 3/1957 | Garrison | 212/160 |
| 3,048,371 | 8/1962 | Klimek, Jr. | 212/160 X |
| 4,560,074 | 12/1985 | Manning | 212/152 |

FOREIGN PATENT DOCUMENTS

| | | | |
|---|---|---|---|
| 163708 | 6/1955 | Australia | 212/179 |
| 0013243 | 2/1977 | Japan | 212/179 |
| 0227892 | 8/1991 | Japan | 212/175 |

*Primary Examiner*—Daniel P. Stodola
*Assistant Examiner*—John Rollins
*Attorney, Agent, or Firm*—Timothy T. Tyson

[57] ABSTRACT

A scaffold mounted hoist (20) is provided which mounts with an adapter (30) on a pin (91) extended upward from the scaffold. An electric motor driven transmission (42) causes a standard (40) to rotate relative to the adapter. A cable from an electric winch (50) on the standard is reeved through a pulley (48) on a boom (44) extending from the standard. The transmission and winch motors respond to receivers (56) in the hoist. Thus a load (28) attached to the cable can be lifted, lowered and swung circumferentially through commands from a hand held transmitter (24). An electric eye system (64) stops the load adjacent the boom. Timers (252, 253) stop the load when it nears, respectively, the ground and the scaffold floor (34).

12 Claims, 5 Drawing Sheets

REMOTE CONTROLLED SCAFFOLD HOIST

TECHNICAL FIELD

The present invention pertains to scaffold mounted hoists and more particularly, to remote controlled scaffold hoists.

BACKGROUND ART

Temporary construction scaffolds are set up at building sites to aid in effecting the construction work. Building materials such as bricks, mortar, stucco and wood have to be transported to the working floor of the scaffold. Also construction tools have to be similarly moved up to the scaffold floor. In the past this movement of materials and tools has been accomplished by hand labor using ladders propped against the scaffold side.

Scaffold mounted hoists have been described for the purpose of replacing some of this hand labor. U.S. Pat. No. 4,560,074 to Manning has a hoist comprising a winch assembly and a boom assembly. The winch assembly has a mounting bracket for attachment to the scaffold. The boom assembly mounts separately using a mast element that has a member shaped to engage and to lock on a structural element of the scaffold. The mast element also has a tube adapted to fit over the top of a scaffold column. A boom is rotatably mounted to the mast element. Pulley means are located near the junction of the mast and boom for guiding a cable through the tube. U.S. Pat. No. 3,858,728 to Fathauer has a radio control unit to send signals to a cargo spreader at the top of a cargo container crane.

Other patents of interest are U.S. Pat. Nos. 2,017,500, 2,203,113, 2,557,852, 2,670,086, 2,686,600, 3,048,371, 4,004,778, 4,191,301, 4,684,031, 4,688,688, 4,718,564, and 4,838,439; Australian Patent 163,708; French Patent 2,306,156; Japanese Patent 52-13243; and Russian Patents 827-369, 840-006, and 1390-177.

DISCLOSURE OF INVENTION

The present invention is directed to a scaffold mounted hoist for moving building materials and tools between the ground and a construction scaffold floor.

Apparatus in accordance with the invention are characterized by a standard adapted to rotate through transmission means on an adapter which mounts on a pin extended upward from the scaffold. Apparatus in accordance with the invention is further characterized by means for winding a cable through reeving means attached to a boom extending outward from the standard. Receiving means cause the transmission means and the winding means to be responsive to transmitted signals. Thus commands from a handheld transmitter may cause a load to be lifted, lowered and rotated relative to the scaffold.

Apparatus in accordance with the invention is further characterized by photocell means for detecting the presence of a load thereby stopping the load adjacent the boom and timer means, initiated by the receiver means, for stopping the load adjacent the ground or the scaffold floor.

In a preferred embodiment a reversible electric winch is mounted on the upper end of a standard and, from the winch, a cable is reeved through a pulley on the outer end of a boom extending outward from the standard. A pair of gears connected by a chain are driven by a second electric motor to rotate the standard relative to an adaptor mounted to a pin extended upward from the scaffold. The electric motors are responsive to a receiver similar to the type used on automatic garage door openers. The receiver is, in turn, responsive to a hand held transmitter.

A photocell directed at the cable is compared to another photocell directed to the area adjacent the cable. The load intercepts light so that the comparison can be used to stop the load adjacent the boom.

Adjustable timers are initiated by the receiving means so that the load may be stopped adjacent the ground and the scaffold floor.

The novel features of the invention are set forth with particularity in the appended claims. The invention will be best understood from the following description when read in conjunction with the accompanying drawings.

MODES FOR CARRYING OUT THE INVENTION

Figure 1:
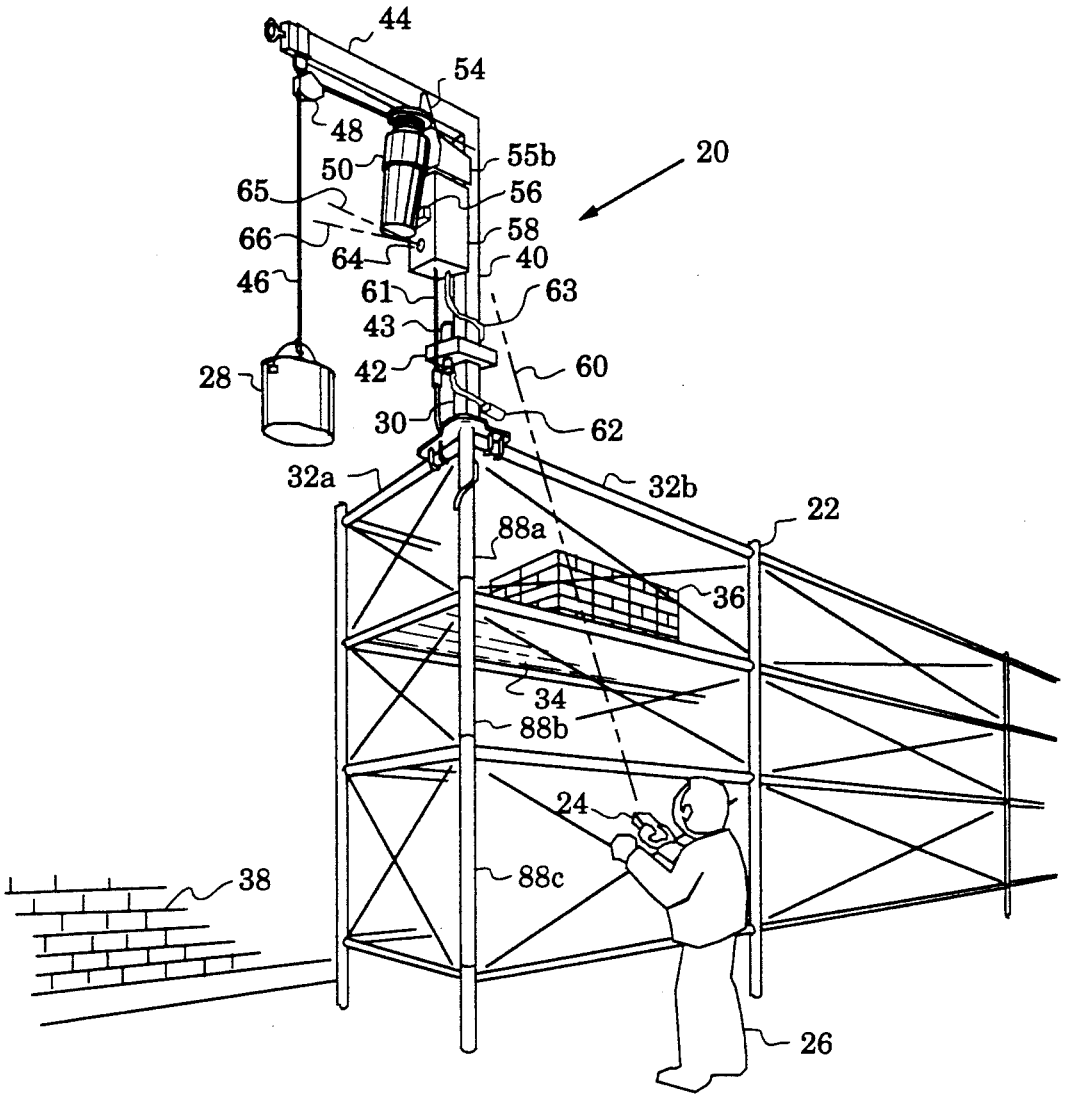
FIG. 1 is a perspective view of a preferred embodiment, in accordance with the present invention, of a remote controlled scaffold hoist.

FIG. 1 is a perspective view of a preferred embodiment of a scaffold hoist 20, in accordance with the present invention, illustrating the scaffold hoist 20 mounted on a construction scaffold 22 and controlled by a hand held transmitter 24. With the aid of the transmitter 24, the hoist operator 26 can cause the load 28 to be raised and lowered and the hoist 20 to be rotated about its adapter 30. Thus a load 28 can be lifted above one of the upper scaffold rails 32*a*, 32*b*, swung to a location above the upper scaffold floor 34 and then lowered to the floor 34 solely under commands from the transmitter 24. In a similar manner loads can be moved from the scaffold floor 34 to the ground.

Use of the scaffold hoist 20 thereby replaces a large amount of hand labor involved in carrying building supplies and equipment up a ladder to the scaffold floor 34. One example of such use of the scaffold hoist is in transporting bricks 36, mortar and other materials to the scaffold floor 34 in the construction of a brick wall or facing 38.

The scaffold hoist 20 comprises a standard 40 that rotates on, and is substantially coaxial with, the adaptor 30 which is fixed to the scaffold 22. The upper part of the adaptor 30 has a transmission 42 which powers the rotation of the standard 40 by means of a reversible electric motor 43. Extending outward from the standard is a boom 44. The standard 40 and the boom 44 are fabricated from square tubing. A cable 46 is attached to the load 28 and is reeved through a pulley 48 on the end of the boom 44 to an electric motor driven winch 50. The winch 50 is reversible allowing the load 28 to be raised and lowered.

Figure 2:
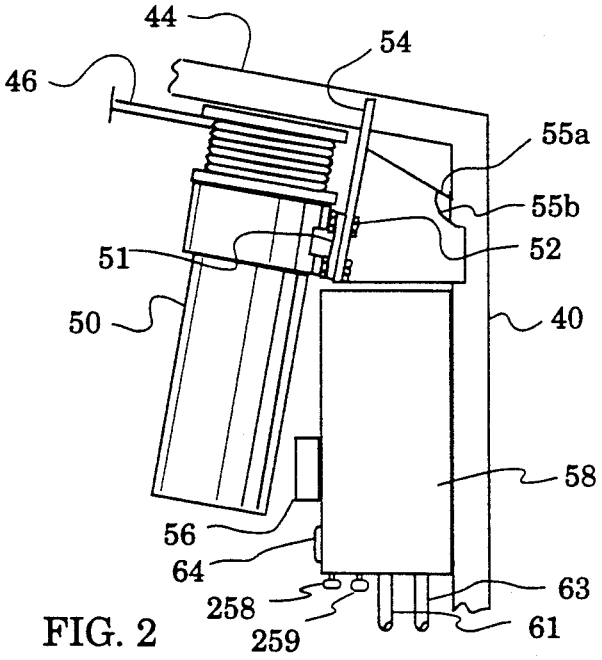
FIG. 2 is an enlarged side elevation view of a portion of the hoist of FIG. 1.

FIG. 2, is an enlarged side elevation view of a portion of FIG. 1. In FIGS. 1 and 2 the winch 50 is seen to have a bracket 51 by means of which it may be removably mounted with conventional hardware 52 (e.g. bolts, washers and nuts) to a gusset 54 that is welded to the boom 44. A gusset 55*a* is welded to the standard 40 and to the gusset 54. A similar gusset 55*b* is welded to the opposite side of the standard 40 and to the gusset 54. Removal of the winch 50 with the hardware 52 facilitates installation and removal of the hoist 20 on the scaffold 22. The gussets 54, 55*a* and 55*b* also strengthen the connection of the standard 40 and the boom 44.

Electronic receiver 56 is attached to a power/control box 58 which is fixed to the standard 40. The receiver 56 contains four receiver channels of a type similar to that employed in garage door openers which are well known in the art. FIG. 1 illustrates the use of electronic signals, indicated by the broken line 60, transmitted from the hand held transmitter 24 to the receiver 56 to allow the operator 26 to command operation of both the winch 50 and the transmission motor 43. Primary electrical power is brought into the power/control box 58 by a power connector 61 which may be routed down a scaffold upright to an electrical source on the ground.

The hoist winch 50 and transmission motor 43 may also be controlled by manual switches located in a control extension 62 which is connected to the power/control box 58 by an electrical cable 63 and is thus available to an operator located on the scaffold floor 34. An electronic eye system 64 aligned along sight line 65 senses the arrival of the load 28 as it nears the boom 44 and automatically stops the winch 50. Knobs 258, 259 at the bottom of the power/control box 58 are described below in connection with the schematic of FIG. 15.

Figure 3:
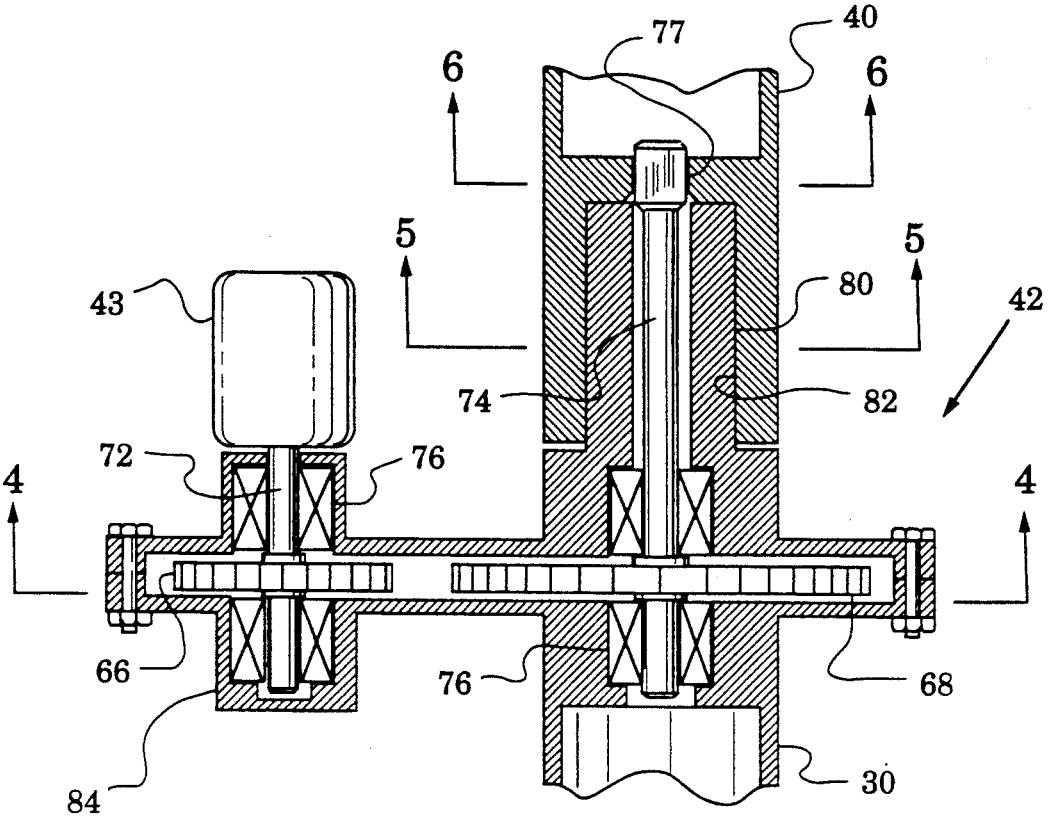
FIG. 3 is a sectional side elevation view of a transmission in the hoist of FIG. 1.
Figure 4:
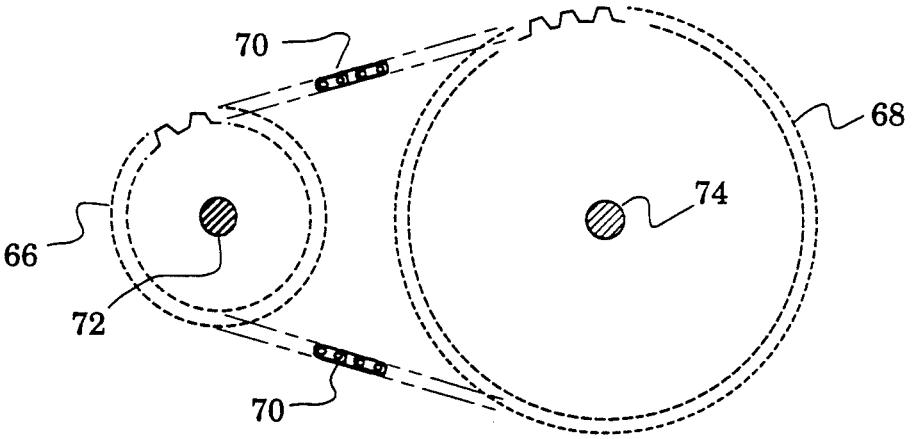
FIG. 4 is a view along the plane 4—4 of FIG. 3.
Figure 5:
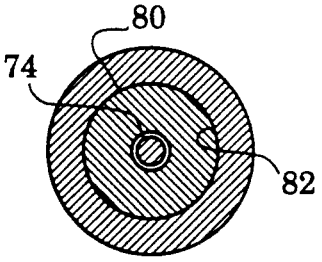
FIG. 5 is a view along the plane 5—5 of FIG. 3.
Figure 6:
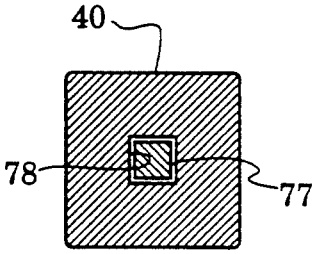
FIG. 6 is a view along the plane 6—6 of FIG. 3.

The operation of the transmission 42 is illustrated in FIG. 3, which is a sectional side elevation view of the transmission, and further illustrated in FIGS. 4, 5 and 6 which are views along the planes 4—4, 5—5, and 6—6, respectively, of FIG. 3. The transmission 42 is seen to have a pair of toothed gears 66, 68 connected by a flexible chain 70. For clarity of illustration, the chain 70 is not shown in FIG. 3. The gears 66, 68 rotate on axles 72, 74 In bearings 76, each of which is indicated conventionally by an "x" within a box. The gear 66 is driven through the axle 72 by the electrical motor 43. The axle 74 ends in a square boss 77 which is received by a corresponding aperture 78 in the standard 40. Rotation of the axle 72 by the motor 43 can thus rotate the standard 40 relative to the adaptor 30.

The adaptor 30 has a cylindrical collar 80 which is closely received in a corresponding bore 82 in the standard 40. The collar 80 thus rotates within the bore 82 while they also provide strength to resist transverse bending forces induced by the load and the boom (28 and 44 of FIG. 1). It should be understood by those skilled in the art that although the housing 84 of the transmission 42 has been shown in FIG. 2 to be comprised of enlarged portions of the adaptor 30, there are numerous possible embodiments of the housing 84 and transmission 42 that fit within the spirit of the invention.

Figure 7:
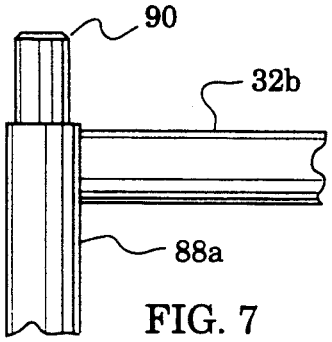
FIG. 7 is an enlarged elevation view of the top of a scaffold upright of FIG. 1.

FIG. 7 is an enlarged elevation view of the upper end of the scaffold upright 88*a* of FIG. 1, and its associated rail 32*b*, illustrating an upward extending pin 90 that is fixed within the upright 88*a*. Construction scaffolds are conventionally assembled by stacking identical scaffold frames upon each other utilizing pins similar to the pin 90. As an illustrative example, each of the uprights 88*a*, 88*b* and 88*c* of FIG. 1 have their open lower end received over the pin in the upper end of the upright below.

Figure 8:
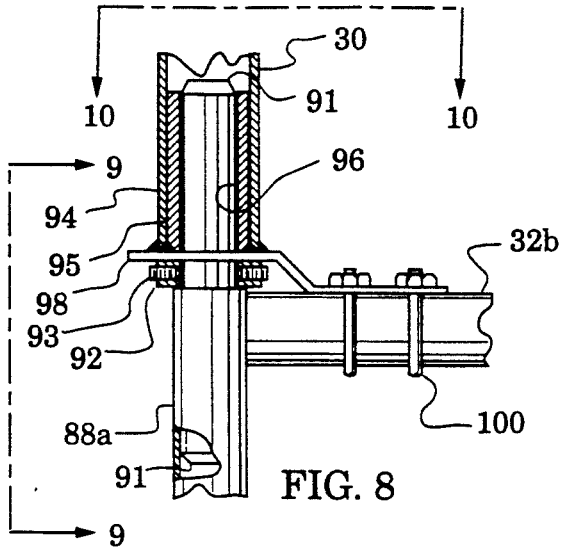
FIG. 8 is a view similar to FIG. 7 illustrating an adapter of the hoist of FIG. 1 mounted to the scaffold upright of FIG. 7.
Figure 9:
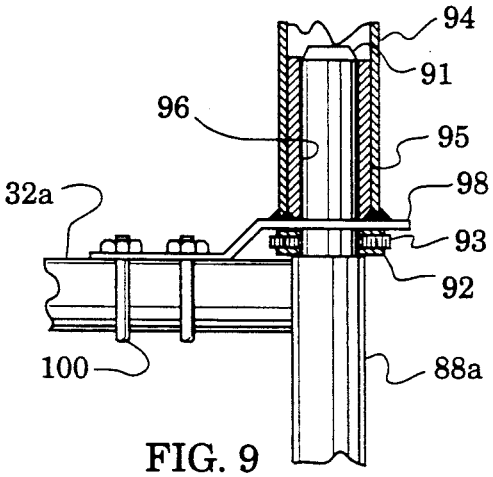
FIG. 9 is a view along the plane 9—9 of FIG. 8.
Figure 10:
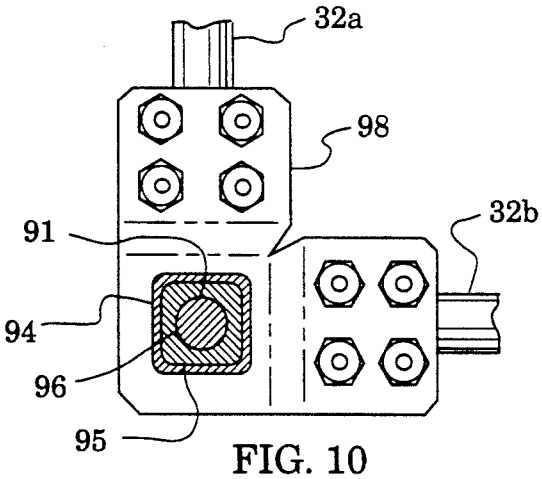
FIG. 10 is a view along the plane 10—10 of FIG. 8.

FIG. 8 is a view similar to FIG. 7 while FIG. 9 and FIG. 10 are views along the plane 9—9 and the plane 10—10, respectively, of FIG. 8. FIGS. 8, 9 and 10 illustrate that the pin 90 is replaced with an extended pin 91. The pin 91 is approximately three feet long and capable of supporting bending loads imposed by the adaptor 30. A ring 92 slides over the pin 91 and is fixed with set screws 93 thereto, thus determining the vertical location of the pin 91 relative to the upright 88*a*. The upright 88*a* is broken away to show the lower end of the pin 91. A leg 94 of the adaptor 30 fits over the pin 91. The leg 94 is of square tubing similar to the standard and boom (40 and 44 in FIG. 1). A sleeve 95 is welded inside the adaptor leg 94 and has a bore 96 that closely receives the pin 91. A gusset 98 is welded to the sleeve leg 92. The gusset 98 is secured to the rails 32*a*, 32*b* with U bolts 100. Thus the leg 92 of the adaptor 30 is secured over the pin 90 and prevented from rotating relative to the scaffold (22 in FIG. 10).

Figure 11:
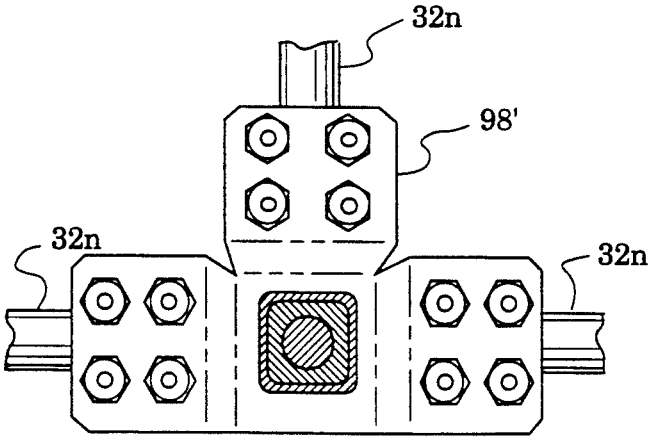
FIG. 11 is a view similar to FIG. 10 of another preferred embodiment of the adapter of the hoist of FIG. 1.

FIG. 11 is a view similar to FIG. 10 illustrating another preferred embodiment of the adaptor employing a gusset 98' which may be used with other combinations of scaffold rails 32*n*. It should be apparent to one skilled in the art that still other embodiments of the gusset 98 may be used without varying from the spirit of the invention.

Figure 12:
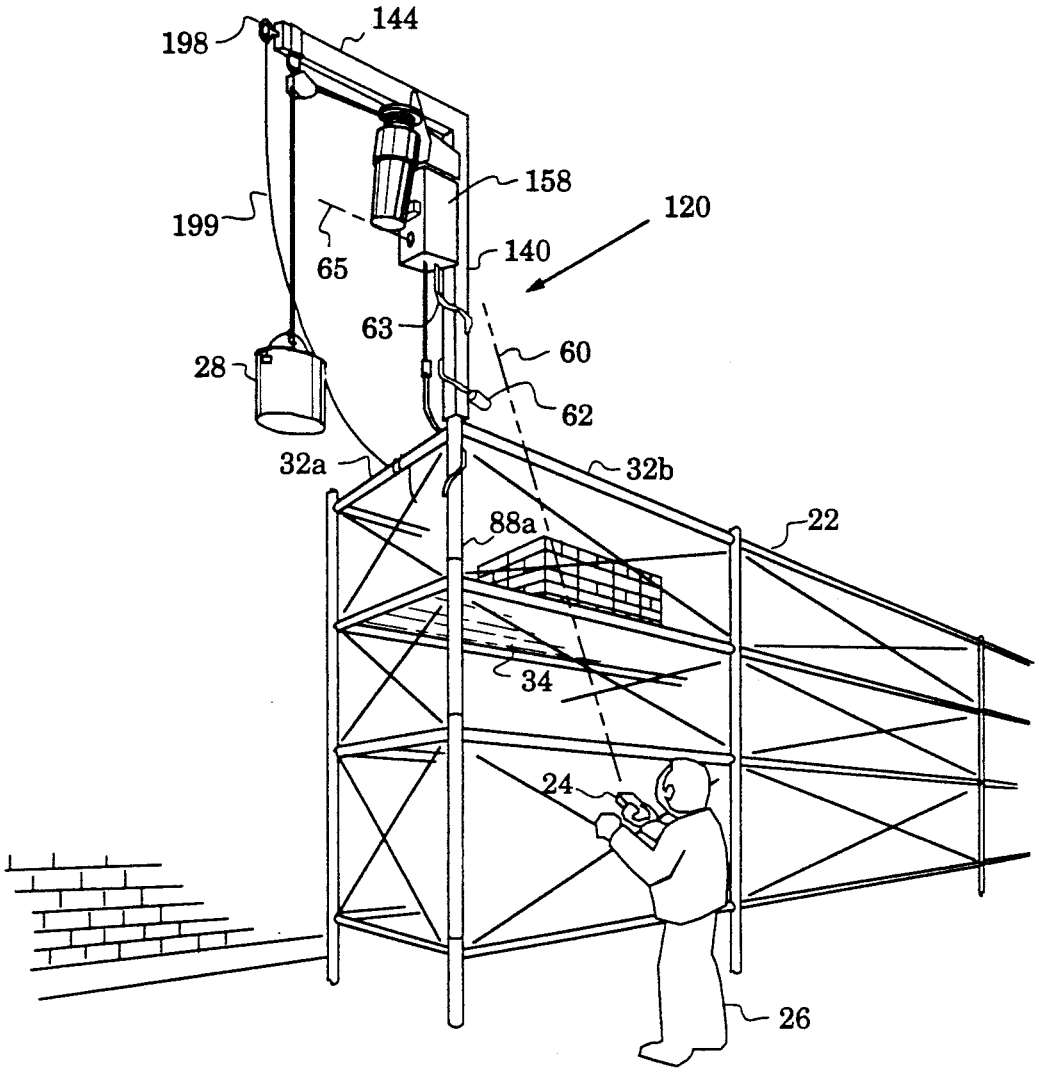
FIG. 12 is a perspective view of another preferred embodiment, in accordance with the present invention, of a scaffold mounted hoist.
Figure 13:
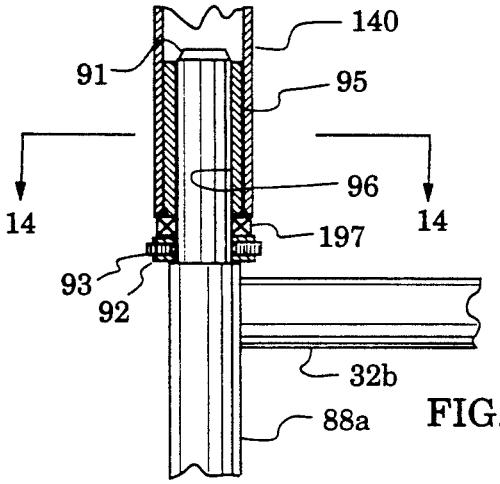
FIG. 13 is a view similar to FIG. 8 illustrating a standard of the hoist of FIG. 12 mounted to the scaffold upright of FIG. 7.

FIG. 12 is a perspective view similar to FIG. 1 illustrating another preferred embodiment, in accordance with the present invention, of a scaffold hoist 120. The hoist 120 has a standard 140 and a boom 144. From the power/control box 158, a control extension 162 extends downward on an electrical cable 163. The standard 140 extends downward to rotatably receive the upward extending pin 91 as shown in FIG. 13 which is a view similar to FIG. 8. A ring 92 is fixed to the pin 91 with set screws 93 to set the vertical position of the pin 91 relative to the upright 88*a*.

Figure 14:
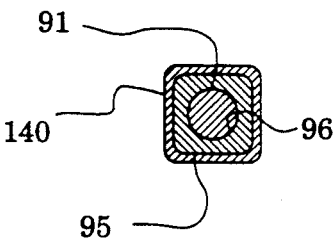
FIG. 14 is a view along the plane 14—14 of FIG. 13.

FIG. 14 is a view along the plane 14—14 of FIG. 13. FIGS. 13 and 14 show that a sleeve 95 is welded to the standard 140. The sleeve 95 has a bore 96 that closely fits the pin 90. A bearing 197 is introduced between the standard 140 and attached sleeve 95 and the ring 92 to reduce friction.

FIG. 12 illustrates a ring 198 fixed to the end of the boom 144 to which a rope 199 is attached. The other features of the hoist 120 are similar to the hoist 20 of FIG. 1.

Thus in the hoist 120 the operator 26 may cause, with electronic signals from the hand held transmitter 24, the load 28 to be raised above one of the rails 32*a*, 32*b*. The hoist 120 may then be rotated relative to the scaffold 22 by manually pulling the rope 198 causing the sleeve 194 to rotate relative to the pin 91. Once the load 28 is above the scaffold floor 34 it may be lowered with commands from the transmitter 24. To move the load 28 from the scaffold floor 34 to the ground, the procedure is reversed. Alternatively, the load 28 may be raised and lowered through use of manual switches in the control extension 62.

Figure 15:
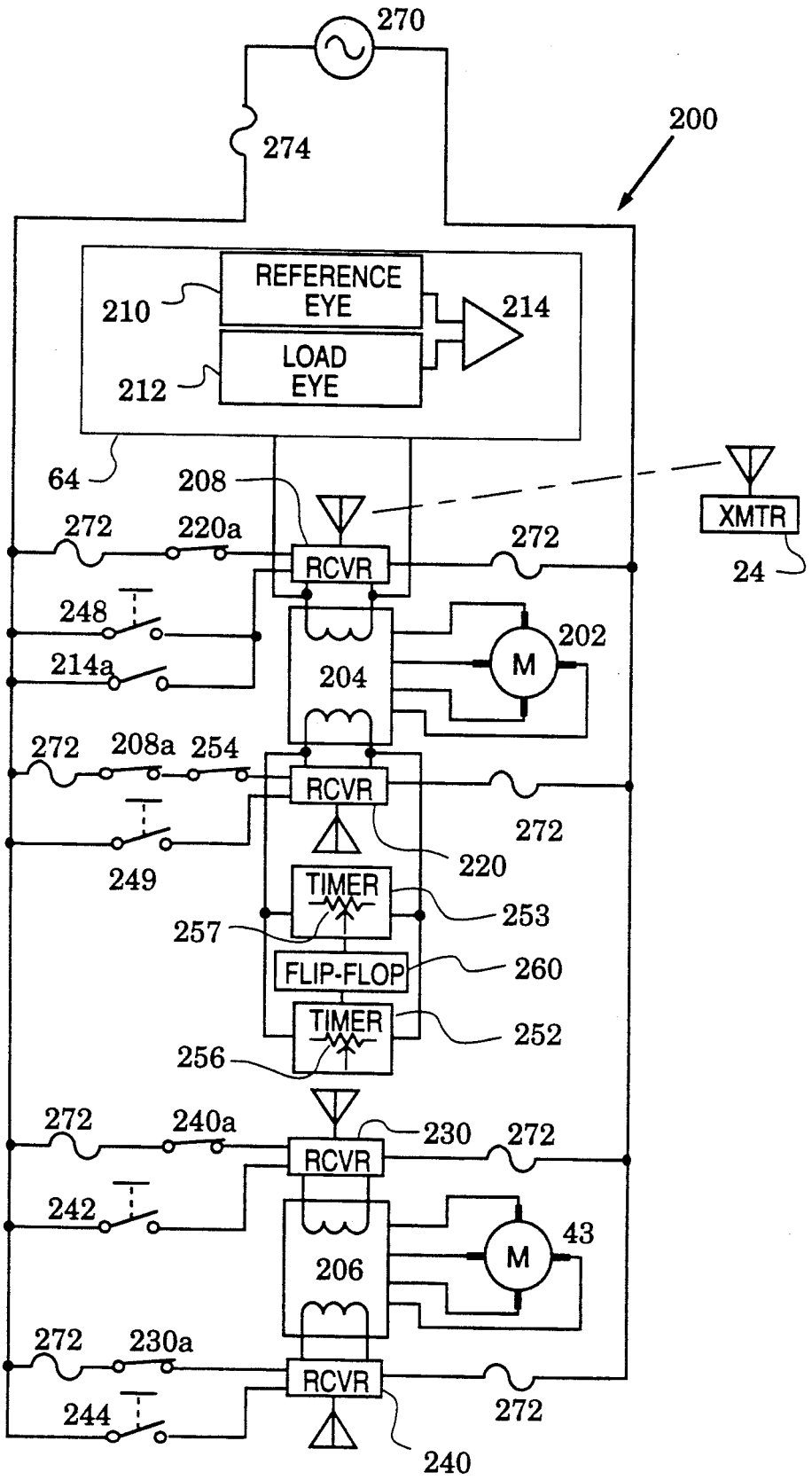
FIG. 15 is a partial electrical schematic of the hoist of FIG. 1.

FIG. 15 is a partial electrical schematic 200 of the scaffold hoist 20 of FIG. 1 illustrating the control system of the motor 202 and the motor 43. The reversible motor 202 is contained within the winch 50 of FIG. 1 and powers the winding of the cable 46 to raise or lower the load 28. The reversible motor 43 is shown in FIG. 1 as the power source to rotate the standard 40 relative to the adaptor 30. The motors 202 and 43 are controlled respectively by reversing contactors 204 and 206.

A signal pulse from one of the four channels of the handheld transmitter (24 in FIG. 1) to the up receiver 208 causes the reversing contactor 204 to energize the motor 202 initiating raising of the load (28 in FIG. 1). The electric eye system (64 in FIG. 1) has a reference electric eye 210 and a load electric eye 212 which utilize photocells to sense received light. The load eye 210 is aimed along the sight line 65 of FIG. 1 which will be intercepted by the load 28 when it nears the boom 44. The reference eye 210 is aimed slightly away from the sight line 65 along an ambient light sense line 66 to sense the ambient light condition. The signal from the load eye 212 is compared with the signal from the reference eye 210 in a comparator 214. When the ambient light is blocked from the load eye 210 by the load 28, the comparator 214 output changes state which closes switch 214*a*. This causes the reversing contactor 204 to deenergize the motor 202 stopping the load 28 short of the boom 44.

A pulse signal from another channel of the transmitter 24 to the down receiver 220 causes the reversing contactor 204 to energize the motor 202 in the reverse rotation so that the load 28 is lowered from the boom 44. A signal to receiver 208 opens switch 208*a* while a signal to receiver 220 opens switch 220*a*.

In a similar manner the clockwise receiver 230 and the counterclockwise receiver 240 may be sent pulse signals from other channels of the transmitter 24 causing the motor 43 to be energized correspondingly by the reversing contactor 206. This causes the load to be swung circumferentially about the adaptor (30 of FIG. 1). A signal to receiver 230 opens switch 230*a* while a signal to receiver 240 opens switch 240*a*.

The motor 43 may also be controlled by manual switches 242 and 244 which are located in the control extension (62 of FIG. 1). In a similar manner the motor 202 may be controlled by manual switches 248 and 249 which are also located in the control extension 62. Thus the motors 202 and 43 may be controlled either by the handheld transmitter 24 or the control extension 62.

Either a first timer 252 or a second timer 253 can open the switch 254 which causes the reversing contactor 204 to stop the motor 202. These timers are initiated by the down receiver 204 and can thus stop the motor 202 after it has been started by a pulse signal to the down receiver 204. The timers 252 and 253 may be set to stop the load short, respectively, of arrival at the ground and arrival at the scaffold floor.

The timers 252, 253 are monostable flip flops whose time is controlled by an RC (resistance times capacitance) time constant. The parameter R for each timer is set by corresponding variable resistors 256, 257 in the power/control box 58 which are controlled, respectively, by knobs 258 and 259 shown in FIG. 2. A flip-flop 260 initiates the selection, by the down receiver 220 of the timers 252, 253. Either timer can be selected out of this alternating sequence by selecting the down receiver 220 twice in succession.

The circuit of schematic 200 is powered from a conventional source 270 and is protected by fuses 272 and a circuit breaker 274. The circuit is housed in the power/-control box (58 in FIG. 1) with the exception of the motors 202 and 43 and the manual switches 242, 2442 248 and 249 which are in the control extension 62. The receivers 208, 220, 230 and 240 are contained mechanically in the receiver 56 indicated in FIGS. 1 and 2. The schematic for the hoist 120 of FIG. 1 is similar to the schematic 200 with the circuits associated with the motor 43 removed.

From the foregoing it should be recognized that a remote controlled scaffold hoist has been disclosed herein configured to lift or lower a load and, in addition, rotate it relative to the scaffold. The hoist is additionally configured to automatically stop the load when it reaches the boom of the hoist, the floor of the scaffold or the ground. Although the present invention has been described with reference to preferred embodiments, numerous modifications and rearrangements can be made with the equivalent result still embraced within the scope of the invention.

What is claimed is:

1. A remote controlled scaffold hoist mountable on a pin projecting upward from a scaffold, comprising:

means for receiving transmitted signals;

an adaptor having an upper end and a lower end, said lower end adapted for receiving said pin;

a standard having an upper end and a lower end, said standard substantially coaxial with said adaptor and carrying said receiving means;

transmission means, connecting said adaptor upper end and said standard lower end and responsive to said receiving means, for rotating said standard relative to said adaptor;

a boom extending outwardly from said standard upper end;

a cable;

means, mounted on said standard and responsive to said receiving means, for bidirectional winding of said cable; and rotatable means attached to said boom for reeving said cable from said winding means to a load;

lifting, lowering and circumferential movement about said adaptor of the load thereby responsive to the transmitted signals.

2. A hoist as defined in claim 1 further comprising means, affixed to said adaptor lower end, for clamping to a scaffold rail to prevent rotation of said adaptor relative to the scaffold.

3. A hoist as defined in claim 2 wherein said rotating means comprises:

a chain driven transmission; and an electric motor for driving said transmission.

4. A hoist as defined in claim 3 further comprising:

photocell means for detecting the load when it is hoisted to a predetermined position relative to said boom; and switch means, responsive to said photocell means, for stopping said winding means when load reaches said position.

5. A hoist as defined in claim 4 wherein said photocell means comprises:

first photocell means for receiving light along a sight line which intercepts said cable;

second photocell means for receiving ambient light from a region adjacent to said sight line; and comparator means for detecting a differential in the outputs of said first and second photocell means due to interception of light to said first photocell means by the load on said cable.

6. A hoist as defined in claim 5 wherein said winding means comprises a reversible electric winch.

7. A hoist as defined in claim 5 further comprising an electronic transmitter for generating said transmitted signals.

8. A hoist as defined in claim 7 further comprising:

first timer means, initiated by said receiver means, for stopping winding of said cable whereby the load may be stopped adjacent the ground; and second timer means, initiated by said receiver means, for stopping winding of said cable whereby the load may be stopped adjacent a floor of the scaffold.

9. A hoist as defined in claim 8 further comprising manual switch means, adapted to cooperate with said receiver means, for controlling said transmission means and said winding means.

10. A remote controlled scaffold hoist mountable on a pin projecting upward from a scaffold, comprising:

an adaptor having an upper end and a lower end, said lower end adapted for receiving said pin;

a standard having an upper end and a lower end, said standard substantially coaxial with said adaptor;

transmission means, coupled between said adaptor upper end and said standard lower end, for rotating said standard relative to said adaptor;

a boom extending outwardly from said standard upper end;

a cable;

means, carried by said standard, for bidirectional winding of said cable; and rotatable means attached to said boom for reeving said cable from said winding means to a load.

11. A hoist as defined in claim 10 further comprising means, carried by said standard, for receiving transmitted signals;

and wherein said transmission means and said winding means are responsive to said receiving means.

12. A hoist as defined in claim 10 further comprising an electrical switch carried by said standard;

wherein said transmission means and said winding means are responsive to said switch.

* * * * *